US006154885A

United States Patent [19]

Kobayashi et al.

[11] Patent Number: 6,154,885

[45] Date of Patent: Dec. 5, 2000

[54] GOLF GLOVES

[75] Inventors: Seiji Kobayashi; Kaoru Shinki, both of Tokyo, Japan

[73] Assignee: Les Gants Co., Ltd., Kita-gun, Japan

[21] Appl. No.: 09/446,112

[22] PCT Filed: Apr. 23, 1999

[86] PCT No.: PCT/JP99/02160

§ 371 Date: Dec. 23, 1999

§ 102(e) Date: Dec. 23, 1999

[87] PCT Pub. No.: WO99/55433

PCT Pub. Date: Nov. 4, 1999

[30] Foreign Application Priority Data

Apr. 27, 1998 [JP] Japan ..... 10-131025

[51] Int. Cl.[7] ..... A41D 19/00

[52] U.S. Cl. ..... 2/161.3; 2/161.2

[58] Field of Search ..... 2/159, 161.1, 161.2, 2/161.3, 161.4, 161.6; 473/205

[56] References Cited

U.S. PATENT DOCUMENTS 5,251,335 10/1993 DeFusco ..... 2/163
5,511,248 4/1996 Widdemer ..... 2/161.3
5,644,795 7/1997 Landis et al. ..... 2/161.3
5,708,979 1/1998 Redwood et al. ..... 2/161.1

*Primary Examiner*—John J. Calvert
*Assistant Examiner*—Katherine Moran
*Attorney, Agent, or Firm*—Oblon, Spivak, McClelland, Maier & Neustadt, P.C.

[57] ABSTRACT

At least part of both the back part and palm part of glove body of a golf glove is formed from a stretch material. On the back part side of the glove body, the stretch material continues all the way from the vicinity of the tips of the index, middle, ring and little finger parts to the vicinity of the lower edge at the wrist end. On the palm part side of the glove body, the index, middle, ring and little finger parts, the thumb part and the palm part comprise non-slip patches which afford interior properties of expansion and contraction in comparison with the stretch material but serve to prevent slipping. The index, middle, ring and little finger parts on the palm part side of the glove body are separated from the palm part by a horizontal band of stretch material formed in such a manner that the areas of the third joints of the index, middle, ring and little finger parts are continuous with one another, the thumb part and palm part being separated by a vertical band of stretch material formed so as to continue from the vicinity of the lower edge at the wrist end of the palm part to the horizontal band in the area of the third joint of the index finger part.

10 Claims, 6 Drawing Sheets

GOLF GLOVES

FIELD OF THE INVENTION

The present invention relates to a golf glove, and in particular to a free-size type golf glove which fits any golfer's hand irrespective of size and ensures a firm grip.

DESCRIPTION OF THE RELATED ART

Golf gloves must of their nature fit the golfer's hand perfectly in order to ensure a firm grip. For this reason, manufacturers have hitherto been forced to manufacture numerous different sizes of glove in accordance with the circumference of the knuckle. Meanwhile, users have often found, for instance in the case of junior players' gloves, that as a result of body growth a size ceases to fit them in a short period of time, making it necessary to purchase the correct size every season.

Thus, conventional golf gloves have presented problems in that manufacturers have had to prepare them in numerous different sizes, while users have found it necessary frequently to purchase a new pair in line with body growth, particularly in the case of junior players.

These problems may be eliminated if a glove body is made of stretch material of the sort generally known as two-way stretch, thus allowing it to fit the golfer's hand irrespective of size.

However, it is inconvenient for the whole of the glove body to be made of stretch material in that while it fits the hand well, such the material has a tendency to slip, making it impossible to grip the golf club firmly and resulting in mistaken shots.

It is an object of the present invention to eliminate the aforesaid conventional problems and inconveniences, and to provide a free-size type golf glove which can be made to fit any golfer's hand perfectly irrespective of size, while endowing the palm part side with the required slip resistance to ensure a firm grip.

SUMMARY OF THE INVENTION

With a view to attaining the aforesaid object, the first invention is a golf glove, most of the back part side and palm part side of the glove body of which is formed from a stretch material which expands and contracts freely in the vertical, horizontal and oblique directions, wherein;

non-slip patches of synthetic, artificial or natural leather, which afford inferior properties of expansion and contraction in comparison with the stretch material but serve to prevent slipping, are sewn on to the palm part side of the glove body, in such a manner that stretch material is exposed all the way from the vicinity of the tips of the index, middle, ring and little finger parts on the palm part side to the vicinity of the lower edge at the wrist end of the glove body without any discontinuity.

More specifically, it is a golf glove, most of the back part side and palm part side of the glove body of which is formed from a stretch material which expands and contracts freely in the vertical, horizontal and oblique directions, wherein:

non-slip patches of synthetic, artificial or natural leather, which afford inferior properties of expansion and contraction in comparison with the stretch material but serve to prevent slipping, are sewn on to the middle, ring and little finger parts on the palm part side of the glove body in a position inward from the edge of the stretch material which forms the glove body, while on the index finger part made of the stretch material the non-slip patch is sewn on so as to continue round from the palm part side to the back part side but leave the stretch material exposed at the upper edge and on the side edge of the back part side, said non-slip patch further being sewn on to the palm part of the glove body so as to leave the stretch material exposed along the lower edges of the finger parts and around the thumb part on the palm part side, with the result that stretch material is exposed all the way from the vicinity of the tips of the index, middle, ring and little finger parts to the vicinity of the lower edge at the wrist end of the glove body without any discontinuity.

Generally speaking if the whole of a glove body is made of two-way stretch material and patches of synthetic leather or a similar material are sewn on all over the palm part side of the glove body with the combined purpose of strengthening it and preventing slipping, the range of expansion and contraction of these patches is very small, and hence, it fails to match the greater range of expansion and contraction of the glove body, rendering it impossible to produce a free-size type golf glove in this manner.

However, the first golf glove to which the present invention pertains has non-slip patches sewn on to the palm part side of the glove body, which is made of stretch material. These non-slip patches, which afford inferior properties of expansion and contraction in comparison with the stretch material but serve to prevent slipping, are sewn on in such a manner that stretch material is exposed all the way from the vicinity of the tips of the index, middle, ring and little finger parts on the palm part side to the vicinity of the lower edge at the wrist end of the glove body without any discontinuity. This means that it is possible to eliminate any element which might impede the expanding and contracting action of the stretch material, making it possible to produce the glove of a free size, while at the same time ensuring firmness of grip owing to the non-slip action afforded by the non-slip patches.

Moreover independent non-slip patches are sewn on to the little finger part, ring finger part and middle finger part on the palm part side of the glove body in a position inward from the edge of the stretch material (that is to say, in the form of "islands"), and a non-slip patch is sewn on to the index finger part made of the stretch material in such a manner as to continue round from the palm part side to the back part side but leave the stretch material exposed at the upper edge and on the side edge of the index finger part on the back part side. In addition, a non-slip patch is sewn on to the palm part of the glove body so as to leave the stretch material exposed along the lower edges of the finger parts and around the thumb part on the palm part side, with the result that the stretch material is exposed all the way from the vicinity of the tips of the index finger part, middle finger part, ring finger part and little finger part to the vicinity of the lower edge at the wrist end of the glove body without any discontinuity. This allows the stretch material to expand and contract in a satisfactory manner. The glove fits irrespective of the size of the golfer's hand, and permits a firm grip to be maintained owing to the slip resistance afforded by the non-slip patches.

In the first golf glove to which the present invention pertains, it is desirable to form a cut-out section either in the non-slip patch on the index finger part in a position corresponding to that of the second joint, thus exposing the stretch material in the cut-out section, or on the side edge of the non-slip patch on the palm part of the glove body, thus also exposing the stretch material. By exposing the stretch material in the cut-out sections in the non-slip patch on the index finger part in the position corresponding to that of the second joint and on the side edge of the non-slip patch on the palm part of the glove body, it is possible to inhibit the incidence of wrinkles which occur when the non-slip patches are folded inwards, thus reducing any feeling of unnaturalness when the golf club is gripped, and ensuring that it is difficult to make any mistaken shots.

Moreover, it is desirable for the side edge of the thumb part on the back part side to be formed of stretch material, and the side edge of the non-slip patch which forms the palm part side to be sewn on to this stretch material. What is more, it is also desirable for a cut-out section to be formed in a position within the non-slip patch which forms the palm part side of the thumb part, and for stretch material to be sewn on to this cut-out section. If the side edge of the back part side of the thumb part is formed of stretch material in this manner, the side edge of the non-slip patch which constitutes the palm part side being sewn on to this stretch material, the non-slip patch allows the strength with which the golf club is held to be improved, thus rendering the grip even firmer. If at that time a cut-out section is formed in a position within the non-slip patch which constitutes the palm part side of the thumb part, and stretch material is sewn on to this cut-out section, the palm part side of the thumb part is allowed to stretch freely, thus further improving the sensations of fit and stretch.

In order not only to attain the aforesaid object but also to intensify the sensation of fit when the club is held, it is as a general rule desirable for the stretch material and non-slip patches not to overlie each other except where they are sewn on, thus rendering the whole glove as thin as possible. A golf glove of this sort is provided satisfactorily by the second invention as described below.

In other words, the second invention provides a golf glove, at least part of both the back part side and palm part side of a glove body of which is formed from a stretch material, wherein:

on the back part side of the glove body, the stretch material continues all the way from the vicinity of the tips of the index, middle, ring and little finger parts to the vicinity of the lower edge at the wrist end of the back part;

on the palm part side of the glove body, the index, middle, ring and little finger parts, the thumb part and the palm part comprise non-slip patches which afford interior properties of expansion and contraction in comparison with the stretch material but serve to prevent slipping; and the index, middle, ring and little finger parts on the palm part side of the glove body are separated from the palm part by a horizontal band of stretch material formed in such a manner that the areas of the third joints of the index, middles ring and little finger parts are continuous with one another, the thumb part and palm part being separated by a vertical band of stretch material formed so as to continue from the vicinity of the lower edge at the wrist end of the palm part up to the horizontal band in the area of the third joint of the index finger part.

The golf glove to which the second invention pertains, being structured in this manner, makes it possible to eliminate any elements which might obstruct expansion and contraction of the stretch material, thus allowing it to be manufactured of a free size type, while the superior non-slip action afforded by the non-slip patches not only makes it possible to ensure a firmer grip, but also serves to improve the sensation of fitting, As with the first invention, it is desirable that the non-slip patch on the index finger part be sewn on in such a manner as to continue round from the palm part side, which is formed of stretch material, to the back part side. For the sake of strength it is also desirable that the stretch material and non-slip patch overlie one another doubly.

Furthermore, in order to reduce any feeling of unnaturalness when holding the golf club, it is desirable that a cut-out section be formed in the non-slip patch on the index finger part in the area of the second joint. Meanwhile, with a view to allowing freedom of movement to the thumb part, it is further desirable that the side edge of the thumb part on the back part side is formed of stretch material, being sewn on to the side edge of the non-slip patch on the thumb part on the palm part side.

DESCRIPTION OF THE PREFERRED EMBODIMENTS

Figure 1:
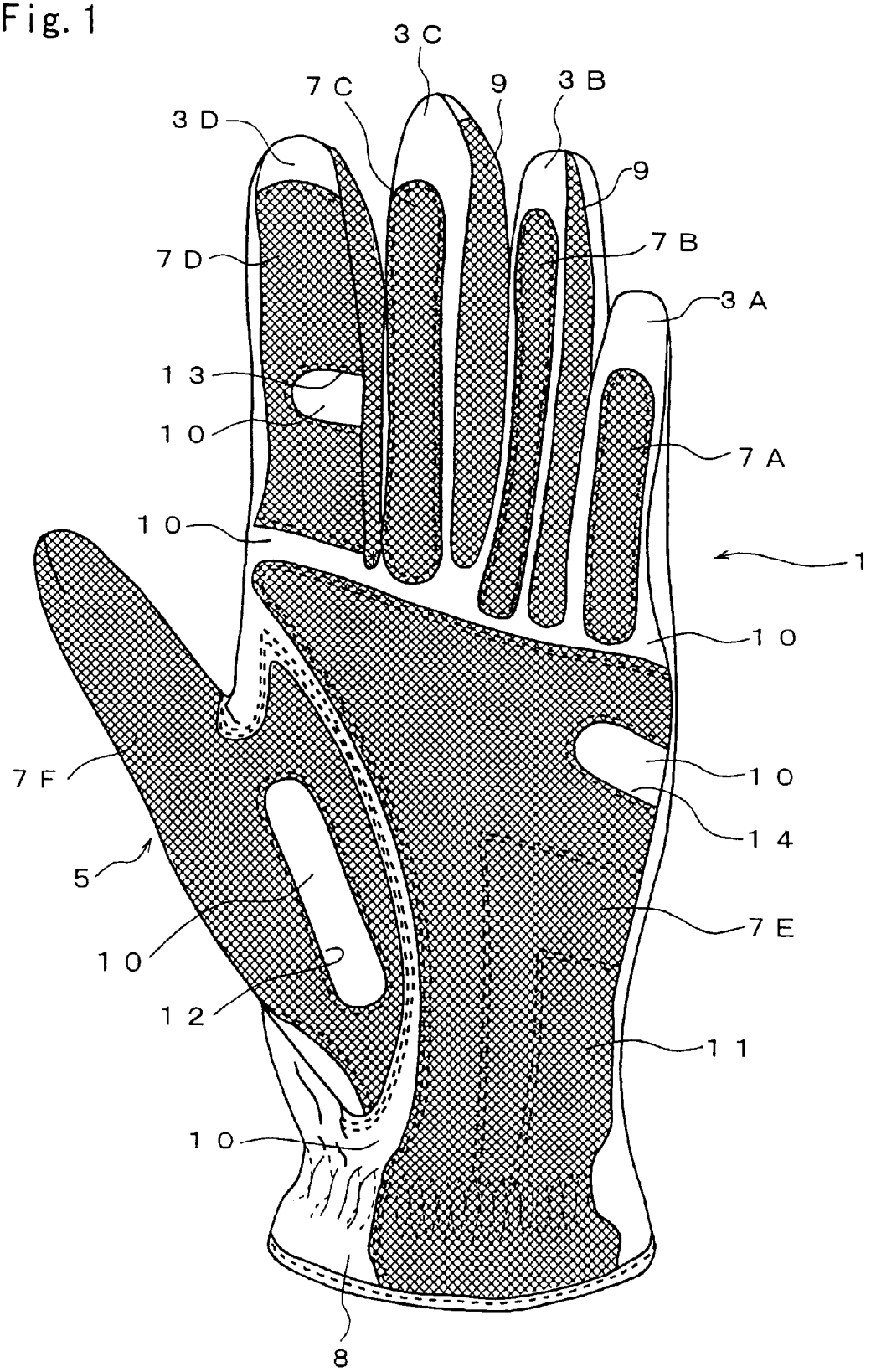
FIG. 1 is a perspective view illustrating an embodiment of the first golf glove to which the present invention pertains.

There follows, with reference to the embodiments which are illustrated in the drawings, a detailed description of the structure of the golf glove to which the present invention pertains.

Figure 2:
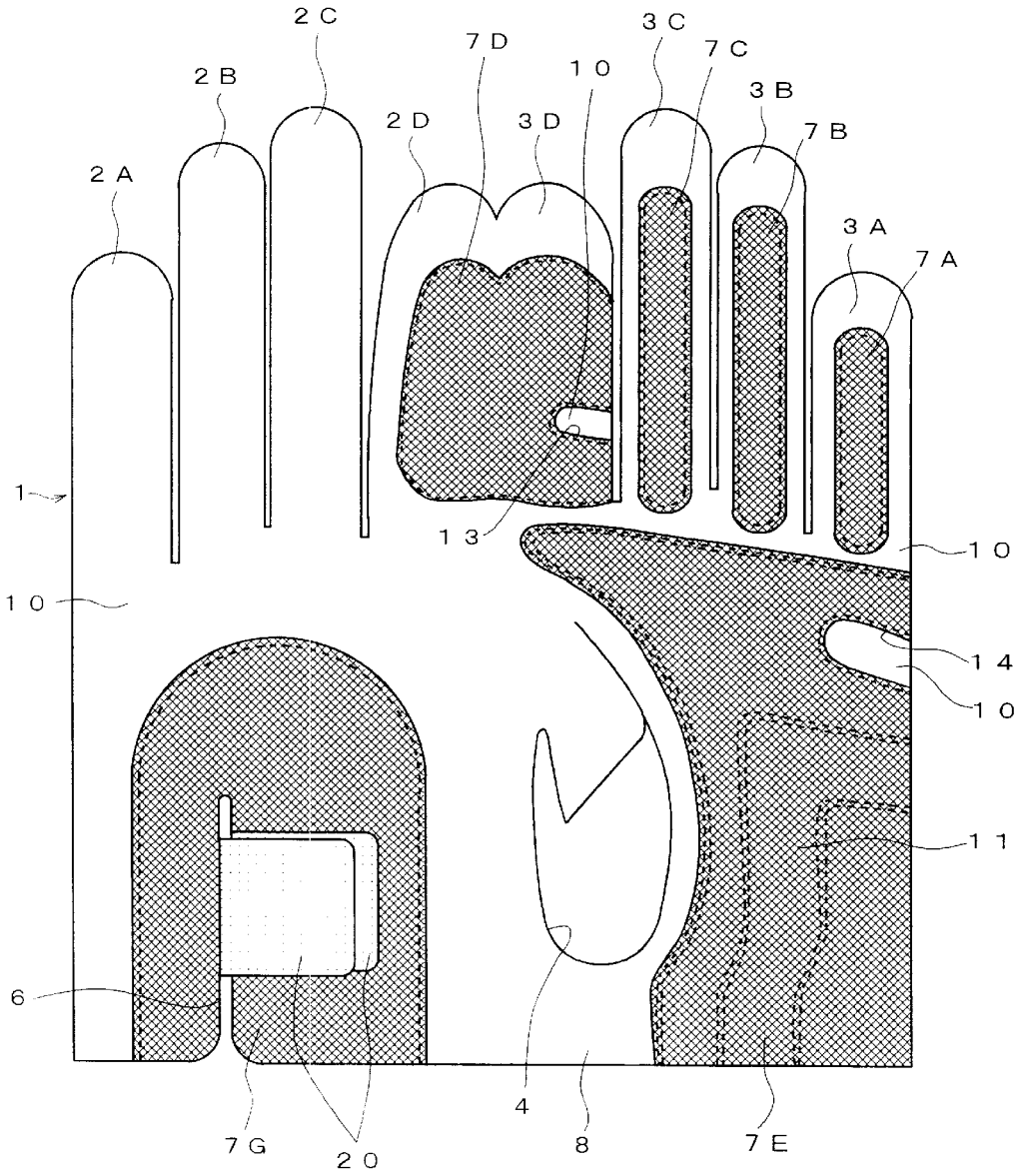
FIG. 2 is a developed view of the glove body which is illustrated in FIG. 1.
Figure 3:
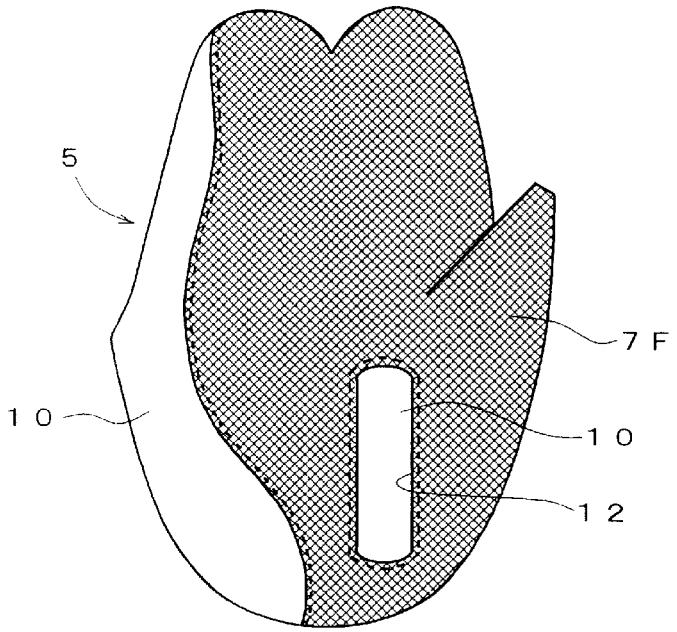
FIG. 3 is a developed view of the thumb part of the golf glove which is illustrated in FIG. 1.
Figure 4:
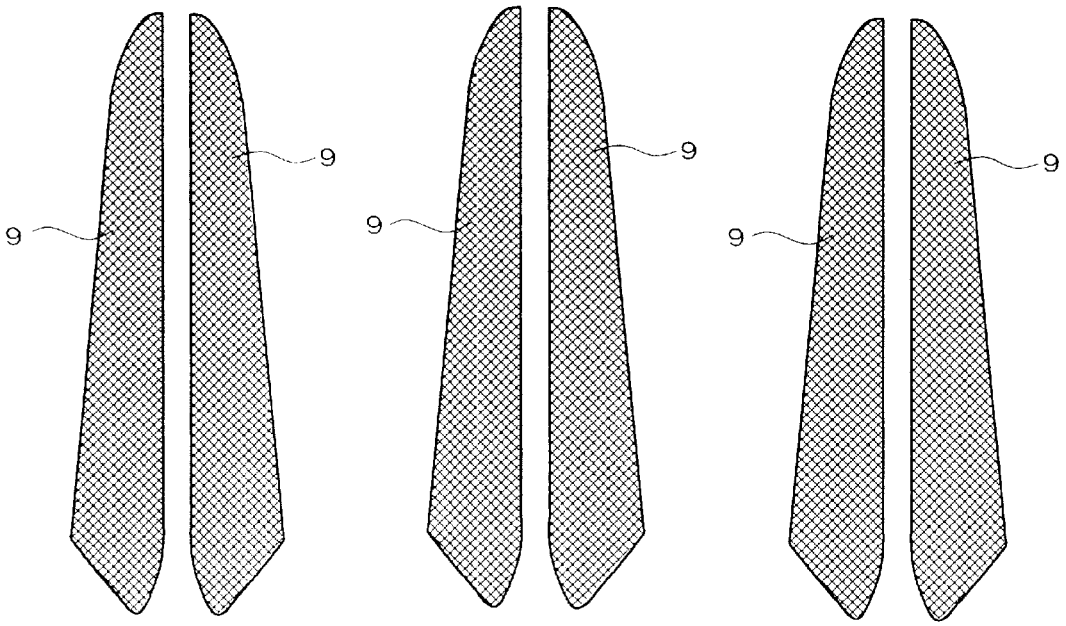
FIG. 4 is a developed view of gussets sewn in between each of the finger parts of the golf glove which is illustrated in FIG. 1.

FIG. 1 is a perspective view illustrating an embodiment of the first golf glove to which the present invention pertains; FIG. 2 is a developed view of the glove body for the golf glove which is illustrated in FIG. 1; FIG. 3 is a developed view of the thumb part of the golf glove which is illustrated in FIG. 1; and FIG. 4 is a developed view of gussets sewn in between each of the finger parts of the golf glove which is illustrated in FIG. 1.

In FIGS. 1 and 2, the numeral "1" is the glove body, most of the back part side and palm part side of which is formed from a stretch material 10 which not only expands and contracts freely in the vertical, horizontal and oblique directions, but is tough, exhibiting powerful resistance to friction, and also highly moisture-absorbent. Examples of a stretch material 10 of this sort include two-way tricots of polyurethane knitted with nylon or polyester, and synthetic leather comprising two-way way tricots immersed in urethane resin or bonded with urethane sheet.

To explain FIG. 2, which shows the glove body 1 developed, the back part side comprises a back-side little finger part 2A, back-side ring finger part 2B, back-side middle finger part 2C and back-side index finger part 2D. Meanwhile, the palm part side comprises a palm-side little finger part 3A, palm-side ring finger part 3B, palm-side middle finger part 3C and palm-side index finger part 3D. The back part and palm part sides of the glove are joined at the index finger parts 2D, 3D. The developed glove body 1 has a cut-out section 4 corresponding to the position of the thumb part 5. The thumb part 5 is produced separately and sewn on to this cut-out section 4.

A slit 6 is formed towards the wrist on the back part side of the glove body 1. This slit 6 opens to allow the finished golf glove to be put on and taken off with ease. The twin sections of a hook-and-loop fastener 20 are attached around the slit 6, so that the slit 6 can be closed by fastening the hook-and-loop fastener 20 once the glove is on the wearer's hand.

The golf glove to which the present invention pertains consists basically of the glove body 1, most of the back part side and the palm part side of which is formed from a stretch material 10 of the sort described above. Non-slip patches are sewn on in prescribed positions on the palm part side of the glove body 1. These serve to prevent slipping, while not impeding the expansion and contraction afforded by the stretch material 10 which forms the main part of the glove, and not so as to interfere with the free size of the glove.

In the drawings, 7A, 7B, 7C, 7D, 7E, 7F and 7G all denote non-slip patches, which comprise patches of synthetic, artificial or natural leather. These afford inferior properties of expansion and contraction in comparison with the stretch material 10, but serve to prevent slipping.

The non-slip patch 7G may be omitted according to circumstances.

As has already been pointed out, the non-slip patches are sewn on to the palm part side of the glove body in such a manner as not to impede the expansion and contraction offered by the stretch material 10. More precisely, they are sewn on in such a manner that stretch material 10 is exposed on the surface all the way from the vicinity of the tips of the little finger part 3A, ring finger part 3B and middle finger part 3C on the palm part side to the vicinity of the lower edge 8 at the wrist end of the glove body 1 without any discontinuity. As may be seen from FIG. 2, the back part and palm part sides of the index finger parts 2D, 3D are joined, and in this case a non-slip patch 7D is sewn on so as to continue round from the palm part side to the back part side but leave the stretch material 10 exposed at the upper edge and on the side edge of the back part side.

Thus, the non-slip patches are sewn on so that when the glove is developed, stretch material 10 is exposed all the way from the vicinity of the tips of the finger parts to the vicinity of the lower edge 8 at the wrist end of the glove body 1 without any discontinuity. Accordingly, when the golf glove is produced by folding the developed glove body in two in the vicinity of the centre, sewing the end sections together, and inserting and sewing gussets 9 as illustrated in FIG. 4 between each of the finger parts, the stretch material 10 which forms the glove body of the golf glove is able to expand and contract vertically horizontally and obliquely without its properties of expansion and contraction being impeded in any way by the presence of the non-slip patches. In addition, it is able fully to accommodate all differing sizes of hand.

At the same time, the fact that non-slip patches are sewn on in the required positions on the palm part side in order to prevent slipping allows the golf club to be gripped firmly.

The gussets 9 may be made of the same material as the aforesaid non-slip patches, thus serving to prevent slipping between each of the fingers, or they may be made of the stretch material 10.

In the finished golf glove illustrated in FIG. 1, most of the back part and palm part sides which form the glove body 1 are made of the aforesaid stretch material 10, while the non-slip patches 7A, 7B and 7C are sewn respectively on to the little finger part 3A, ring finger part 3B and middle finger part 3C on the palm part side of the glove body 1 in a position inward from the edge of the stretch material 10 (that is to say, in the form of "islands"). The non-slip patch 7D is sewn on to the index finger parts 2D and 3D made of the stretch material in such a manner as to continue round from the index finger part 3D of the palm part side to the index finger part 2D of the back part side but leave the stretch material 10 exposed at the upper edge and on the side edge of the index finger part 2D on the back part side. In addition, a non-slip patch 7E is sewn on to the palm part 11 of the glove body 1 so as to leave the stretch material 10 exposed along the lower edges of the finger parts and around the thumb part 5, with the result that the stretch material 10 is exposed all the way from the vicinity of the tips of the index finger parts 2D, 3D, middle finger part 3C, ring finger part 3B and little finger part 3A to the vicinity of the lower edge 8 at the wrist end of the glove body 1 without any discontinuity.

Consequently, the glove body, which is made of stretch material, is able to expand and contract freely in the vertical, horizontal and oblique directions without any impedance to its properties of expansion and contraction. In addition, it fits irrespective of the size of the golfer's hand, allowing a firm grip to be maintained owing to the non-slip action afforded by the non-slip patches 7A to 7F which are sewn on in the requisite positions on the palm part side;

Inasmuch as the non-slip patch 7E sewn on to the palm part 11 of the glove body 1 often bears a greater load than the other non-slip patches, is it double-stitched as illustrated in FIGS. 1 and 2. What is more, double stitching is implemented not only along the edges of the non-slip patch 7E, but also in two positions inward from this in order to integrate it further with the stretch material 10.

As is shown in FIG. 3, the side edge of the back part side of the thumb part 5 is formed of stretch material 10, and the side edge of the non-slip patch 7F which forms the palm part side is sewn on to this stretch material 10. In other words, the thumb part 5 differs from the glove body 1 in that the non-slip patch 7F and stretch material 10 do not overlie each other. Moreover, if a cut-out section 12 is formed in a position within the non-slip patch 7F which forms the palm part side of the thumb part 5, and stretch material 10 is sewn on to this cut-out section 12, this allows the palm part side of the thumb part 5 to stretch, thus further improving the sensations of fit and stretch.

In FIGS. 1 and 2, the numeral "13" is a cut-out section formed in the non-slip patch 7D on the index finger part in a position corresponding to that of the second joint. By exposing the stretch material 10 in this cut-out section 13 it is possible to inhibit the incidence of wrinkles which occur when the golf club is gripped, thus considerably reducing any feeling of unnaturalness. In the same manner, the numeral "14" is a cut-out section formed on the side edge of the non-slip patch 7E on the palm part 11 of the glove body 1. Exposing the stretch material 10 in this cut-out section 14 again serves to reduce any feeling of unnaturalness when the golf club is gripped.

Thus, the first golf glove to which the present invention pertains has non-slip patches sewn on to the palm part side of the glove body 1, which is made of the stretch material 10. These non-slip patches, which afford inferior properties of expansion and contraction in comparison with the stretch material 10 but serve to prevent slipping, are sewn on in such a manner that stretch material 10 is exposed all the way from the vicinity of the tips of the index finger part 3D, middle finger part 3C, ring finger part 3B and little finger part 3A on the palm part side to the vicinity of the lower edge 8 at the wrist end of the glove body 1 without any discontinuity. This means that it is possible to eliminate any element which might impede the expanding and contracting action of the stretch material 10, and allows the glove to fit perfectly irrespective of differences in hand size, making it possible to produce it of a free size, while at the same time ensuring firmness of grip owing to the non-slip action afforded by the non-slip patches 7A to 7F.

Figure 5:
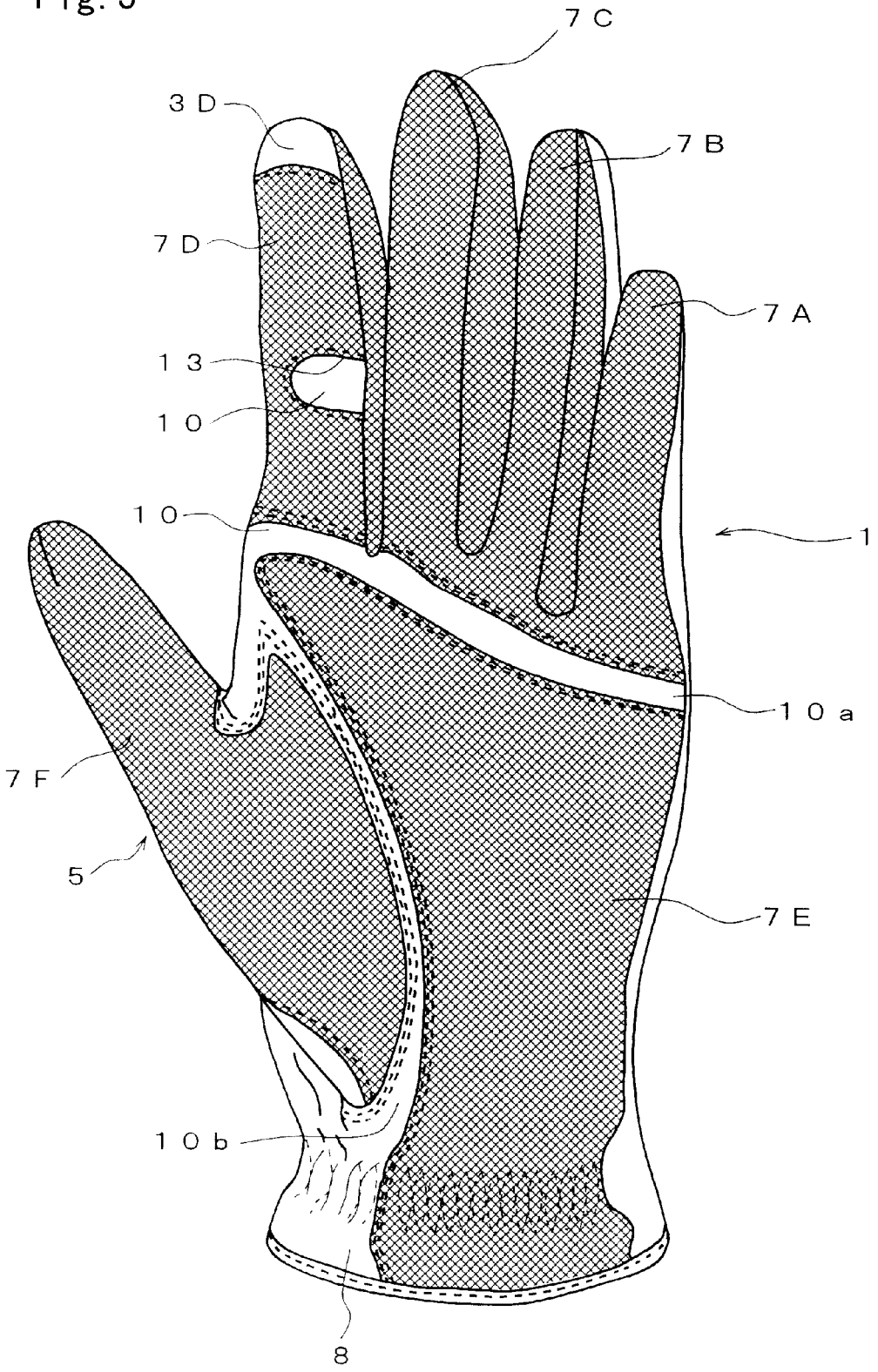
FIG. 5 is a perspective view illustrating an embodiment of the second golf glove to which the present invention pertains.
Figure 6:
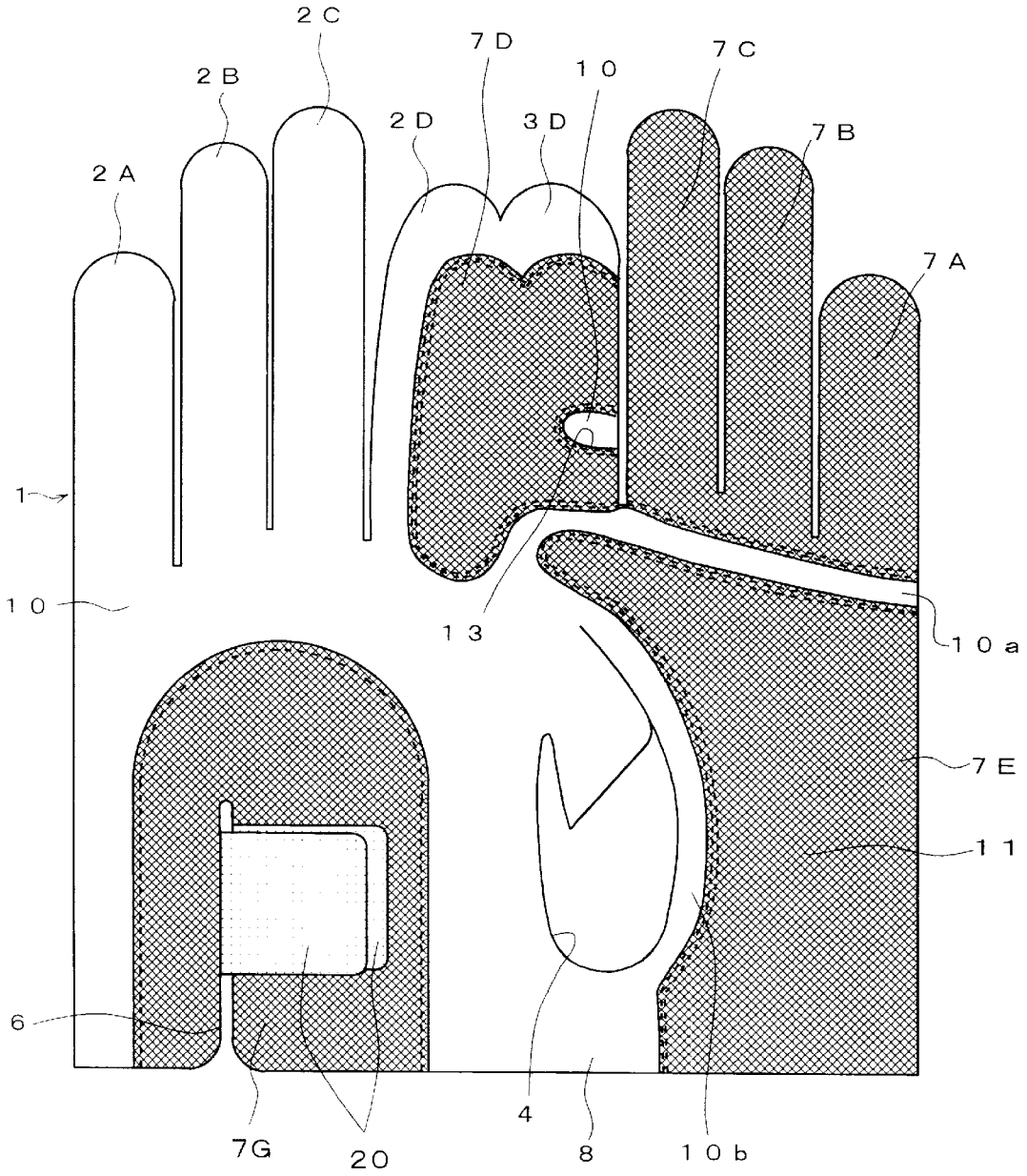
FIG. 6 is a developed view of the glove body which is illustrated in FIG. 5.

There follows a description of an embodiment of the second golf glove to which the present invention pertains. FIG. 5 is a perspective view illustrating an embodiment of the second golf glove to which the present invention pertains; FIG. 6 is a developed view of the glove body which is illustrated in FIG. 5; and FIG. 7 is a developed view of the thumb part of the golf glove which is illustrated in FIG. 5.

Figure 7:
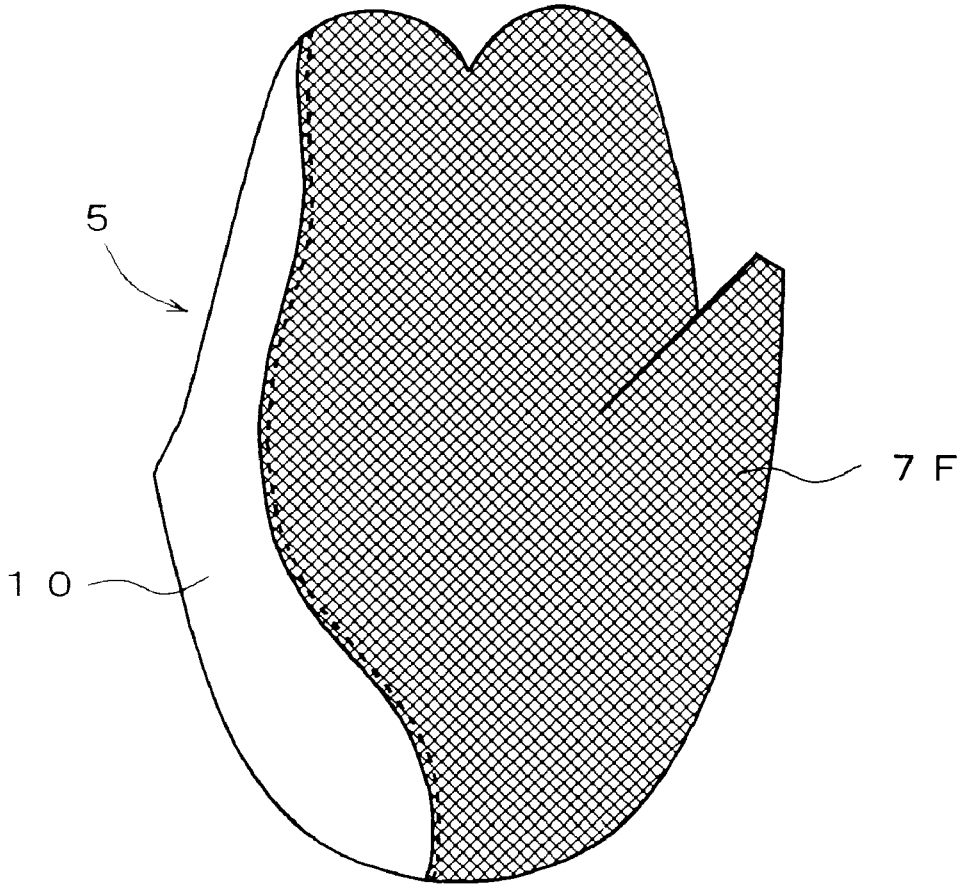
FIG. 7 is a developed view of the thumb part of the golf glove which is illustrated in FIG. 5.

The reference numbers used in FIGS. 5 to 7 have basically the same significance as those which have already been explained in relation to FIGS. 1 to 4.

The description begins with an explanation of FIG. 6, which provides a developed view of the glove body 1.

On the back part side of the glove body 1 of the golf glove are located the back-side little finger part 2A, back-side ring finger part 2B, back-side middle finger part 2C and back-side index finger part 2D, while on the palm part side are located the index finger 3D, which is made of the stretch material 10, and the little finger non-slip patch 7A, ring finger non-slip patch 7B and middle finger non-slip patch 7C. The back part and palm part sides of the glove are joined at the index finger parts 2D, 3D. Moreover, the developed glove body 1 has a cut-out section 4 corresponding to the position of the thumb part 5 (cf. FIG. 5). The thumb part 5 is produced separately and sewn on to this cut-out section 4. What is more, the index finger non-slip patch 7D is sewn on to the index finger part 3D.

In the interests of simpler sewing, the little finger non-slip patch 7A, ring finger non-slip patch 7B and middle finger non-slip patch 7C on the palm part side may be joined in the area of the finger roots.

In the second golf glove to which the present invention pertains, at least a part of both the back part and palm part of the glove body 1 is formed from stretch material 10. Non-slip patches are sewn on in prescribed positions on the palm part side of the glove body. These serve to prevent slipping, while not impeding the expansion and contraction afforded by the stretch material 10 which forms the main part of the glove, and not so as to interfere with the free size of the glove. The numeral "7E" is a non-slip patch sewn on to the palm part.

As described above, the non-slip patches are sewn on to the palm part side of the glove body so as not to impede the expansion and contraction of the stretch material 10. To be more precise, they are sewn on in such a manner that the stretch material 10 continues and is exposed on the surface all the way from the vicinity of the tips of the index finger part 2D, middle finger part 2C, ring finger part 2B and little finger part 2A on the back part side to the vicinity of the lower edge at the wrist end of the back part.

As may be seen from FIG. 6, the back part and palm part sides of the index finger parts 2D, 3D are joined, and in this case a non-slip patch 7D is sewn on so as to continue round from the palm part side to the back part side but leave the stretch material 10 exposed at the upper edge and on the side edge of the back part side. The numeral "7F" is a non-slip patch sewn on to the thumb part.

Meanwhile, the index finger part 3D (index finger non-slip patch 7D), middle finger non-slip patch 7C, ring finger non-slip patch 7B and little finger non-slip patch 7A on the palm part side of the glove body 1 are separated from the palm non-slip patch 7E by a horizontal band 10*a* of stretch material 10 formed in such a manner that the areas of the third joints of the index finger part 3D (index finger non-slip patch 7D), middle finger non-slip patch 7C, ring finger non-slip patch 7B and little finger non-slip patch 7A are continuous with one another, while the thumb part 5 and palm non-slip patch 7E are separated by a vertical band 10*b* of stretch material 10 formed so as to continue from the vicinity of the lower edge 8 at the wrist end of the palm non-slip patch 7E up to the horizontal band 10*a* in the area of the third joint of the index finger non-slip patch 7D.

Thus, the non-slip patches are sewn on so that when the glove is developed, stretch material 10 is exposed all the way from the vicinity of the tips of the finger parts on the back part side to the vicinity of the lower edge 8 at the wrist end of the glove body 1 without any discontinuity. The formation of the horizontal band 10*a* and vertical band 10*b* mean that when the finished golf glove is produced by folding the developed glove body in two in the vicinity of the centre, sewing the end sections together, and inserting and sewing gussets 9 as illustrated in FIG. 4 between each of the fingers, the stretch material 10 which forms the glove body is able to expand and contract vertically, horizontally and obliquely without its properties of expansion and contraction being impeded in any way by the presence of the non-slip patches. In addition, it is able fully to accommodate all differing sizes of hand.

At the same time, the fact that non-slip patches are sewn on in the required positions on the palm part side in order to prevent slipping allows the golf club to be gripped firmly.

The gussets 9 may be made of the same material as the aforesaid non-slip patches, thus serving to prevent slipping between each of the fingers, or they may be made of the stretch material 10.

As has already been explained, the glove body, which is made of the stretch material 10, is able to expand and contract freely in the vertical, horizontal and oblique directions without any impedance to its properties of expansion and contraction. In addition, it fits irrespective of the size of the golfer's hand, allowing a firm grip to be maintained owing to the non-slip action afforded by the non-slip patches 7A to 7F which are sewn on in the requisite positions on the palm part side.

What is more, the slit 6 which is formed on the back part side of the glove body 1 on the wrist side of the non-slip patch 7G opens to allow the finished golf glove to be put on and taken off with ease. The twin sections of a hook-and-loop fastener 20 are attached around the slit 6, so that the slit 6 can be closed by fastening the hook-and-loop fastener 20 once the glove is on the wearer's hand. It is also possible to omit the non-slip patch 7G, in which case its place is taken by stretch material 10.

As is shown in FIG. 7, the side edge of the back part side of the thumb part 5 is formed of stretch material 10, and the side edge of the non-slip patch 7F which forms the palm part side is sewn on to this stretch material 10. In other words, even on the thumb part 5, the non-slip patch 7F and the stretch material 10 do not overlie each other.

In FIGS. 5 and 6, the numeral "13" is a cut-out section formed in the non-slip patch 7D on the index finger part in a position corresponding to that of the second joint. By exposing the stretch material 10 in this cut-out section 13 it is possible to inhibit the incidence of wrinkles which occur when the golf club is gripped, thus considerably reducing any feeling of unnaturalness.

Thus, the second golf glove to which the present invention pertains is able to fit perfectly irrespective of differences in hand size, making it possible to produce it of a free size, while at the same time ensuring firmness of grip owing to the non-slip action afforded by the non-slip patches 7A to 7F.

Industrial Applicability

The golf glove to which the present invention pertains is advantageous for the manufacturer because there is no need to manufacture it in a variety of sizes, which means not only that the manufacturing process can be simplified, but that it is easier to manage stocks. For the user it is advantageous particularly in the case of junior players because there is no need to replace it frequently in line with body growth, making it very economical.

What is claimed is:

1. A golf glove, most of a back part side and a palm part side of a glove body being formed from a stretch material which expands and contracts freely in vertical, horizontal and oblique directions, wherein:

non-slip patches of synthetic, artificial or natural leather, having inferior properties of expansion and contraction when compared with the stretch material are sewn on to the palm part side of the glove body, to prevent slipping, such that the stretch material is exposed from a vicinity of tips of index, middle, ring and little finger parts on the palm part side to a vicinity of a lower edge at a wrist end of the glove body and is generally continuous.

2. A golf glove, most of a back part side and a palm part side of a glove body being formed from a stretch material which expands and contracts freely in vertical, horizontal and oblique directions, wherein:

non-slip patches of synthetic, artificial or natural leather, having inferior properties of expansion and contraction when compared with the stretch material, to prevent slipping, are sewn to middle, ring and little finger parts on the palm part side of the glove body in a position inward from an edge of the stretch material;

a non-slip patch is sewn to an index finger part so as to continue round from the palm part side to the back part side leaving the stretch material exposed at an upper edge and on a side edge of the back part side;

said non-slip patch further being sewn to the palm part of the glove body so as to leave the stretch material exposed along lower edges of the finger parts and around a thumb part on the palm part side, with a result that stretch material is exposed from a vicinity of tips of the index, middle, ring and little finger parts to a lower edge at a wrist end of the glove body and is generally continuous.

3. The golf glove according to claim 1 or 2, wherein a cut-out section is formed in the non-slip patch sewn on to the index finger part in a position corresponding to a second joint, this cut-out section exposing the stretch material and thus serving to reduce any feeling of unnaturalness when grasping the golf club.

4. The golf glove according to claims 1 or 2, wherein a cut-out section is formed in a side edge of the non-slip patch sewn on to the palm part of the glove body, this cut-out section exposing the stretch material and thus serving to reduce any feeling of unnaturalness when grasping a golf club.

5. The golf glove according to claims 1 or 2, wherein a side edge of the thumb part on the back part side is formed of the stretch material and wherein a side edge of the non-slip patch on the palm part side is sewn on to this stretch material.

6. The golf glove according to claims 1 or 2, wherein a cut-out section is formed in a position within the non-slip patch which forms the palm part side of the thumb part, said stretch material being sewn on to this cut-out section.

7. A golf glove, at least part of both back part side and palm part side of a glove body being formed from a stretch material, wherein:

on the back part side of the glove body, the stretch material is continuous from a vicinity of tips of index, middle, ring and little finger parts to a vicinity of a lower edge at a wrist end of the back part;

on the palm part side of the glove body, the index, middle, ring and little finger parts, a thumb part and the palm part include non-slip patches having inferior properties of expansion and contraction when compared with the stretch material; and said index, middle, ring and little finger parts on the palm part side of the glove body are separated from the palm part by a horizontal band of the stretch material in such a manner that areas of third joints of the index, middle, ring and little finger parts are continuous with one another, said thumb part and said palm part being separated by a vertical band of the stretch material formed so as to continue from a vicinity of a lower edge at a wrist end of the palm part up to the horizontal band in the area of the third joint of the index finger part.

8. The golf glove according to claim 7, wherein the non-slip patch on the index finger part is sewn on in such a manner as to continue round from the palm part side, which is formed of the stretch material, to the back part side.

9. The golf glove according to claim 7 or 8, wherein a cut-out section is formed in the non-slip patch on the index finger part in an area of a second joint.

10. The golf glove according to claims 7 or 8, wherein a side edge of the thumb part on the back part side is formed of the stretch material and is sewn on to a non-slip patch on the thumb part on the palm part side.

* * * * *